US008826678B2

(12) United States Patent
Nakagawa et al.

(10) Patent No.: US 8,826,678 B2
(45) Date of Patent: Sep. 9, 2014

(54) AIR CONDITIONER

(75) Inventors: Hidetomo Nakagawa, Chiyoda-ku (JP); Yoshikuni Kataoka, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 677 days.

(21) Appl. No.: 13/087,445

(22) Filed: Apr. 15, 2011

(65) Prior Publication Data

US 2012/0012297 A1 Jan. 19, 2012

(30) Foreign Application Priority Data

Jul. 16, 2010 (JP) ..... 2010-161219

(51) Int. Cl.

| | |
|---|---|
| ***F25D 17/00*** | (2006.01) |
| ***F24F 7/00*** | (2006.01) |
| ***F24F 11/00*** | (2006.01) |

(52) U.S. Cl.

CPC ..... *F24F 11/0012* (2013.01); *F24F 11/0034* (2013.01)

USPC ..... 62/177; 236/49.3

(58) Field of Classification Search

USPC ..... 62/177, 178, 186; 236/49.3

See application file for complete search history.

(56) References Cited

U.S. PATENT DOCUMENTS

| | | | | |
|---|---|---|---|---|
| 2005/0034749 | A1* | 2/2005 | Chen et al. | 136/224 |
| 2009/0014545 | A1* | 1/2009 | Horiuchi | 236/49.3 |

FOREIGN PATENT DOCUMENTS

| | | | |
|---|---|---|---|
| CN | 1265734 | A | 9/2000 |
| CN | 101235985 | A | 8/2008 |
| EP | 1 014 011 | A1 | 6/2000 |
| JP | 05-026508 | A | 2/1993 |
| JP | 2000-009323 | A | 1/2000 |
| JP | 2001-208394 | A | 8/2001 |
| JP | 2001-221489 | A | 8/2001 |
| JP | 2002-061925 | A | 2/2002 |
| JP | 2004-061005 | A | 2/2004 |
| JP | 2007-085606 | A | 4/2007 |
| JP | 2007-322062 | A | 12/2007 |
| JP | 2009-257700 | A | 11/2009 |

OTHER PUBLICATIONS

Office Action dated Oct. 2, 2012, issued in corresponding Japanese Patent Application No. 2010-161219, and an English Translation thereof. (4 pages).

Office Action (Notification of the First Office Action) issued on Jul. 5, 2013, by the Chinese Patent Office in corresponding Chinese Patent Application No. 201110094322.3, and an English Translation of the Office Action. (17 pages).

* cited by examiner

*Primary Examiner* — Marc Norman

(74) *Attorney, Agent, or Firm* — Buchanan Ingersoll & Rooney PC

(57) ABSTRACT

In an air conditioner according to the present invention, an indoor unit includes an indoor air temperature detection unit to detect an indoor air temperature, a floor/wall/ceiling temperature detection unit to detect a floor and wall temperature and a ceiling ambient temperature, and a control device including a microcomputer in which a program relating to control of the air conditioner is embedded, wherein, in heating operation or ventilation operation, the control device performs circulator operation of moving air accumulating near a ceiling to a floor when the ceiling ambient temperature detected by the floor/wall/ceiling temperature detection unit becomes higher, by a predetermined threshold value or more, than an indoor air preset temperature set by a user.

15 Claims, 9 Drawing Sheets

AIR CONDITIONER

TECHNICAL FIELD

The present invention relates to an air conditioner.

BACKGROUND ART

Conventionally, with respect to an air conditioner which blows conditioned air from an air outlet in order to air-condition an indoor space, there is disclosed an art in which a means for detecting a first temperature of a first space near a ceiling and a means for detecting a second temperature of a second space near a floor are provided, and when a temperature difference between the first temperature and the second temperature becomes greater than or equal to a predetermined value, an operation of stirring air in the space to be air-conditioned is performed (refer to, e.g., Patent Literature 1).

CITATION LIST

Patent Literature

Patent Literature 1: Japanese Unexamined Patent Publication No. 2007-322062

SUMMARY OF INVENTION

Technical Problem

Since the air conditioner disclosed in Patent Literature 1 performs controlling only based on a difference between a first temperature near a ceiling and a second temperature near a floor, there is a problem if a stirring operation is performed when the current temperature has not reached a preset temperature set by the user, an outdoor temperature is low, etc. after starting the air-conditioning operation, the temperature around the user in the indoor space is lowered contrary to the intent, and thus the user feels uncomfortable.

The present invention is directed to solving the problem as described above and presents an air conditioner by which, when the temperature of the indoor space approaches a preset temperature set by the user and the temperature near the ceiling is higher than the preset temperature in heating operation or ventilating operation, there can be provided a comfortable indoor space without reducing the temperature around the user in the indoor space.

Solution to Problem

An air conditioner according to the present invention including an indoor unit and an outdoor unit comprises, in the indoor unit, an indoor air temperature detection unit, provided at a predetermined position of the indoor unit, to detect an indoor air temperature, a floor/wall/ceiling temperature detection unit, provided at the front of the indoor unit, to detect a floor and wall temperature and a ceiling ambient temperature, and a control device including a microcomputer in which a program relating to control of the air conditioner is embedded, wherein, in heating operation or ventilation operation, the control device performs circulator operation of moving air accumulating near the ceiling to the floor when the ceiling ambient temperature detected by the floor/wall/ceiling temperature detection unit becomes higher, by a predetermined threshold value or more, than an indoor air preset temperature set by a user.

Advantageous Effects of Invention

The air conditioner according to the present invention enables to provide a comfortable indoor space in heating operation or ventilating operation without lowering the temperature around the user in the indoor space, because an indoor control device starts circulator operation of moving air accumulating near the ceiling to the floor when a temperature near the ceiling detected by a floor/wall/ceiling temperature detection unit becomes higher, by a predetermined threshold value or more, than an indoor space preset temperature set by the user.

DESCRIPTION OF EMBODIMENTS

Embodiment 1

Figure 1:
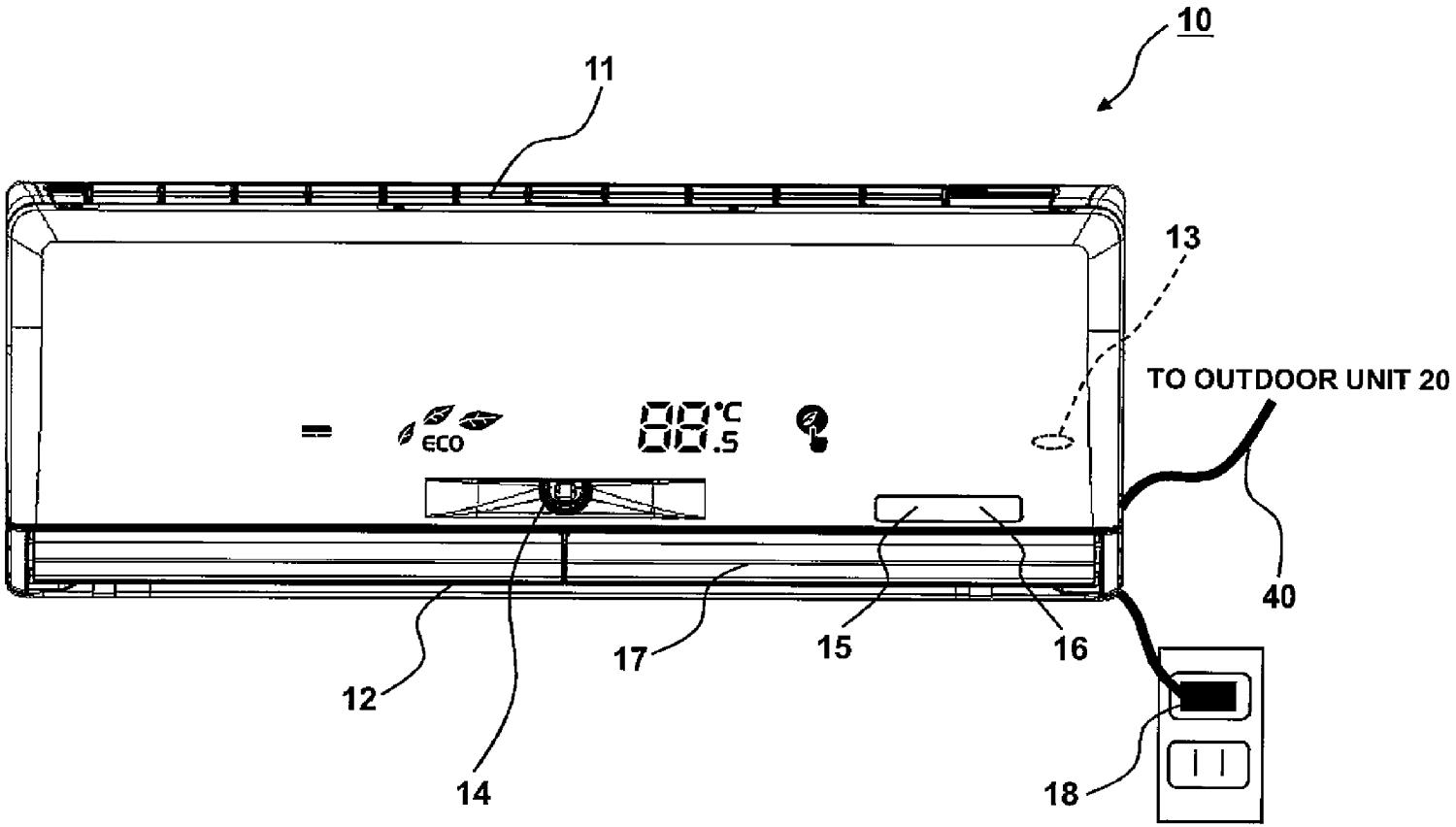
FIG. 1 shows a front view of an indoor unit 10 of an air conditioner according to Embodiment 1.

FIG. 1 shows a front view of an indoor unit 10 of an air conditioner according to Embodiment 1. As shown in FIG. 1, the indoor unit 10 includes a receiving unit 15 at the upper right of an air outlet 12 which is at the front bottom of the indoor unit 10 and which blows conditioned air (air cooled/heated/dehumidified/etc by an indoor heat exchanger not shown). The receiving unit 15 receives an infrared signal from a transmitting unit (not shown) of a remote control device (not shown).

Similarly to the receiving unit 15, a transmitting unit 16 is provided at the upper right of the air outlet 12 which discharges conditioned air. The transmitting unit 16, in which an infrared LED (light-emitting diode) is used, transmits an infrared signal to the remote control device.

Furthermore, there is provided a plug 18 for the indoor unit 10, which is supplied with a power source (commercial power supply (50/60 Hz)) from a socket in the room.

A cable 40 for receiving and transmitting information and control between the indoor unit 10 and an outdoor unit 20 to be described later is connected to a predetermined position at the back of the indoor unit 10. For example, the cable 40 is connected to the left corner of the indoor unit 10 seen from the back.

An indoor temperature sensor 13 (an indoor air temperature detection unit) for measuring a temperature of indoor air and a humidity sensor (not shown) for measuring a humidity of indoor air are provided, for example, near an air inlet 11 for sucking indoor air or at a point of wind flow which is generated by forming an opening in the side of the indoor unit.

Moreover, in the indoor unit 10, there is provided a thermopile type infrared sensor 14 which can measure radiant heat emitted by the floor or the wall, and a temperature of a person.

Although not shown in the figure, a pipe temperature sensor which measures a pipe temperature is provided in the indoor heat exchanger.

Further, although not shown in the figure, an indoor microcomputer which is built in the control device for controlling operations of the air conditioner is stored in an electrical parts box (not shown) of the indoor unit 10, for example. In the indoor microcomputer, programs relating to controlling are stored.

Moreover, although also not shown in the figure, a blower device is mounted in the indoor unit 10 of the air conditioner so that indoor air sucked from the air inlet 11 may be transmitted in order through an air filter, an indoor heat exchanger (plate-fin type) and the air outlet 12, and further, conditioned air may be transmitted into the inside of the room by a louver plate 17. Here, the blower device indicates a cross flow fan, an axial blower, a sirocco fan, etc. and a motor for driving them.

Figure 2:
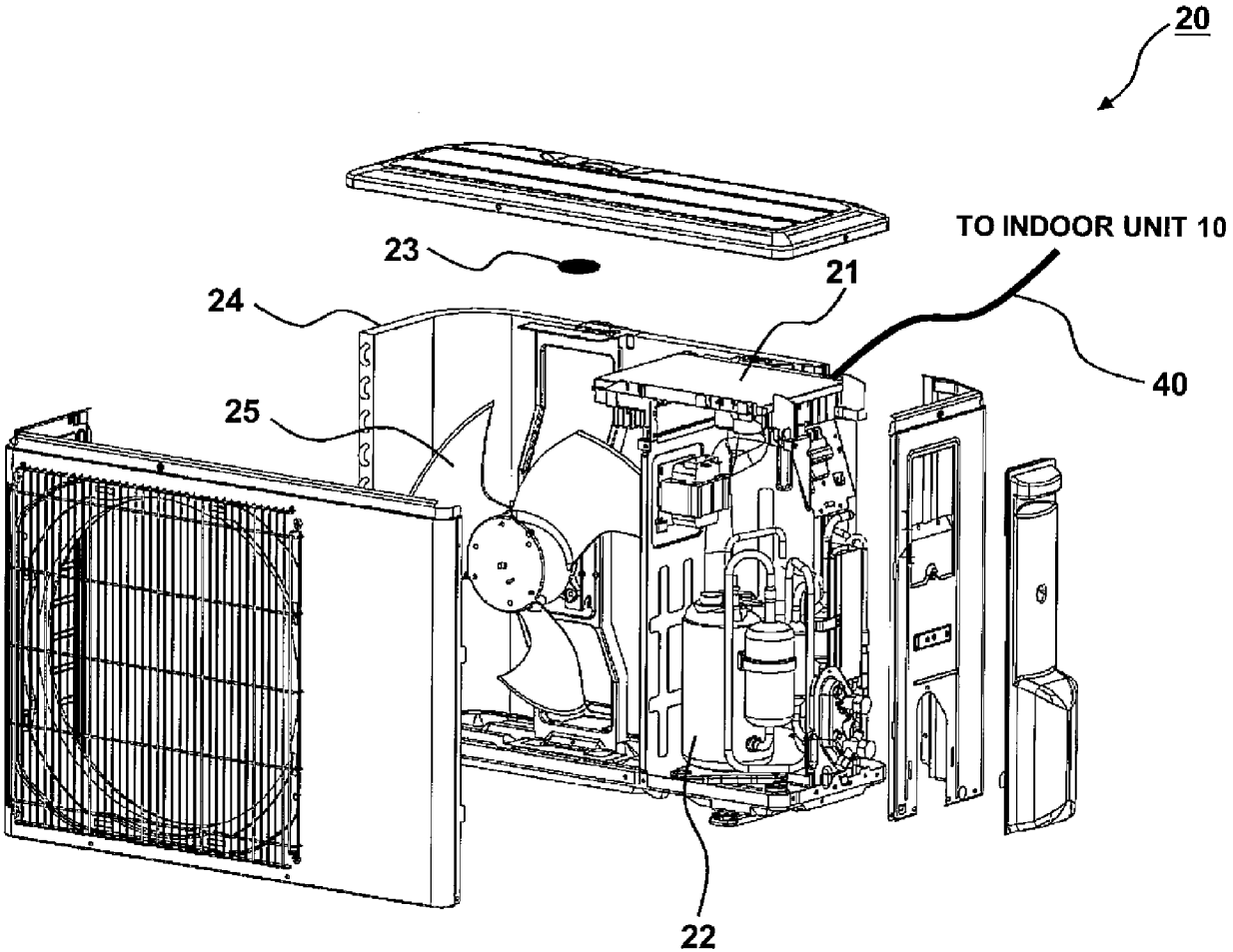
FIG. 2 shows an exploded perspective view of an outdoor unit 20 of the air conditioner according to Embodiment 1.

FIG. 2 shows an exploded perspective view of the outdoor unit 20 of the air conditioner according to Embodiment 1. As shown in FIG. 2, there is stored an outdoor microcomputer in the electrical parts box of the outdoor unit 20, for example. The outdoor microcomputer is built in an outdoor control device 21 which controls operations of the air conditioner.

Moreover, an outdoor temperature sensor 23 which measures an outdoor air temperature is built in the outdoor unit 20. For example, a thermistor is used as the outdoor temperature sensor 23.

Furthermore, a compressor 22, a heat exchanger 24 (plate-fin type), a pressure reducing device (electronic expansion valve), a four-way valve, etc., which form a refrigerating cycle, are mounted in the outdoor unit 20. The compressor 22, which compresses a refrigerant, is such as a rotary compressor, a scroll compressor, or a reciprocating compressor.

In order to promote heat exchange between the refrigerant and the air in the heat exchanger 24, a blower 25 for performing ventilation is provided in the heat exchanger 24. An axial blower serves as the blower 25.

Figure 3:
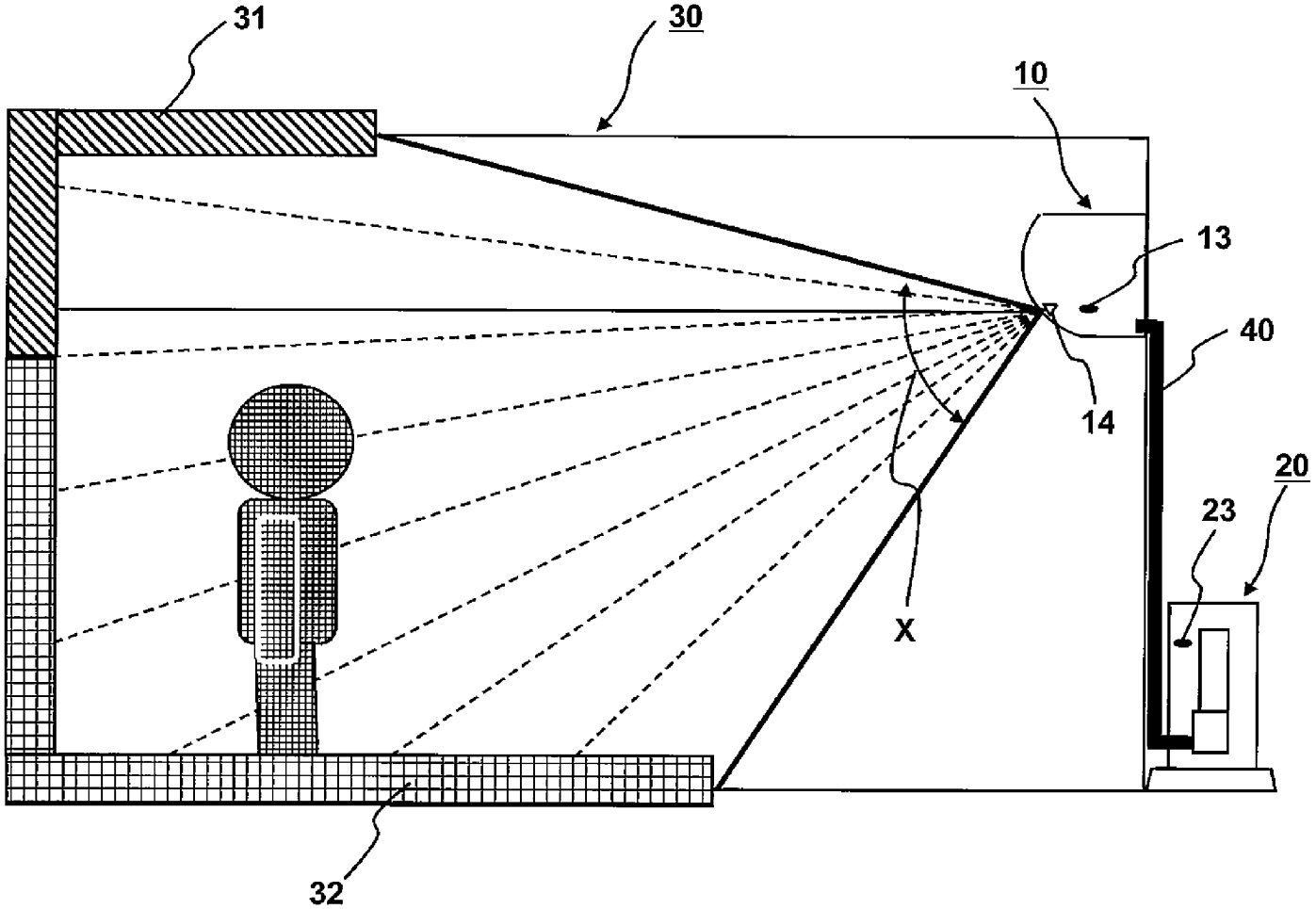
FIG. 3 shows a sectional view depicting a positional relation between an indoor space 30 to be air-conditioned by the air conditioner and the air conditioner (the indoor unit 10 and the outdoor unit 20) according to Embodiment 1.

FIG. 3 shows a sectional view depicting a positional relation between an indoor space 30 to be air-conditioned by the air conditioner and the air conditioner (the indoor unit 10 and the outdoor unit 20) according to Embodiment 1. As shown in the installation example of the air conditioner in FIG. 3, the indoor unit 10 is installed on the upper wall in the indoor space and the outdoor unit 20 is installed outside. The indoor unit 10 and the outdoor unit 20 are connected by the cable 40 for receiving and transmitting information and control and by a refrigerant pipe (not shown) for connecting the indoor heat exchanger and the outdoor heat exchanger.

As shown in FIG. 3, the indoor unit 10 installed in the indoor space 30 includes the indoor temperature sensor 13 which measures a temperature of the indoor air, a humidity sensor (not shown) which measures a humidity of the indoor air, and the thermopile type infrared sensor 14 which can detect a temperature of a point distant from the indoor unit 10. The thermopile type infrared sensor 14 includes a plurality of elements arranged perpendicularly, and thus can measure temperatures of a plurality of ranges divided from a detection range X.

Therefore, as shown in FIG. 3, the thermopile type infrared sensor 14 can detect temperatures of the floor and wall, and near the ceiling (a floor and wall temperature C 32, and a ceiling ambient temperature Ta 31).

Figure 4:
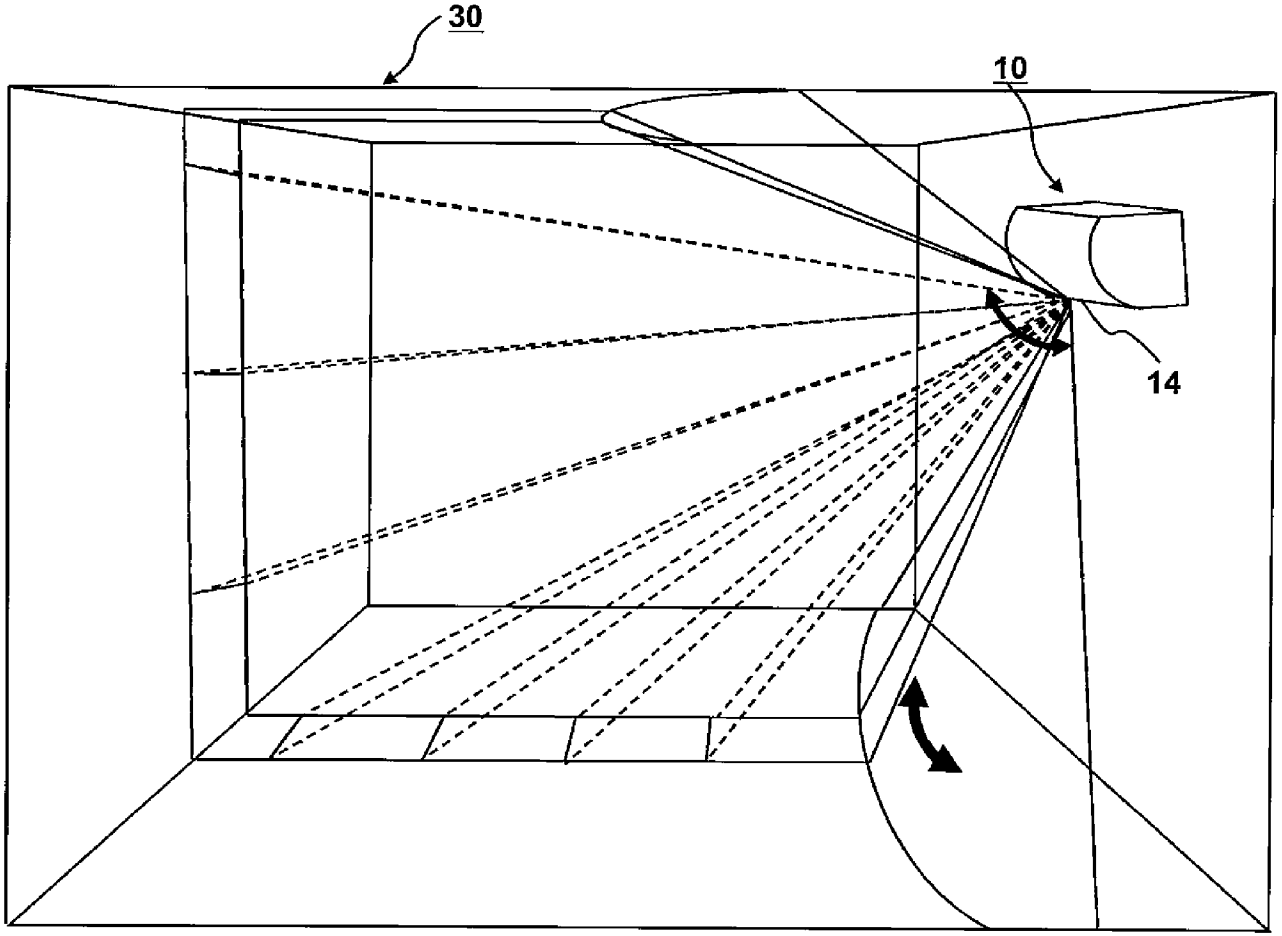
FIG. 4 shows a perspective view depicting a relation between the indoor space 30 to be air-conditioned by the air conditioner and a sensing area of the air conditioner according to Embodiment 1.

FIG. 4 shows a perspective view depicting a relation between the indoor space 30 to be air-conditioned by the air conditioner and a sensing area of the air conditioner according to Embodiment 1. As shown in FIG. 4, by rotating the thermopile type infrared sensor 14 about the axis in the vertical direction of the indoor unit 10, temperatures in the right to left direction can be detected. Thus, it is possible to detect temperatures not only in the height direction but also in the lateral direction of the indoor space 30 as if a plurality of elements were arranged laterally in the thermopile type infrared sensor 14.

Moreover, the thermopile type infrared sensor 14 can measure not only a floor and wall temperature and a ceiling ambient temperature but also a skin temperature of a person. Then, when measuring temperatures in the indoor space 30 by using a plurality of elements arranged perpendicularly and pseudo elements obtained by rotating the perpendicular ones, if a certain point having a higher temperature than the surrounding temperatures is detected, this point can be determined as a place where a person is present.

By storing data on a heat source having been judged to be a person, and examining whether the heat source is moving or stopping, it is possible to discern whether the person is active or inactive.

Moreover, by storing data on movement of the heat source having been judged to be a person, it is possible to grasp the range of the person's activity and guess the shape of the user's room.

Figure 5:
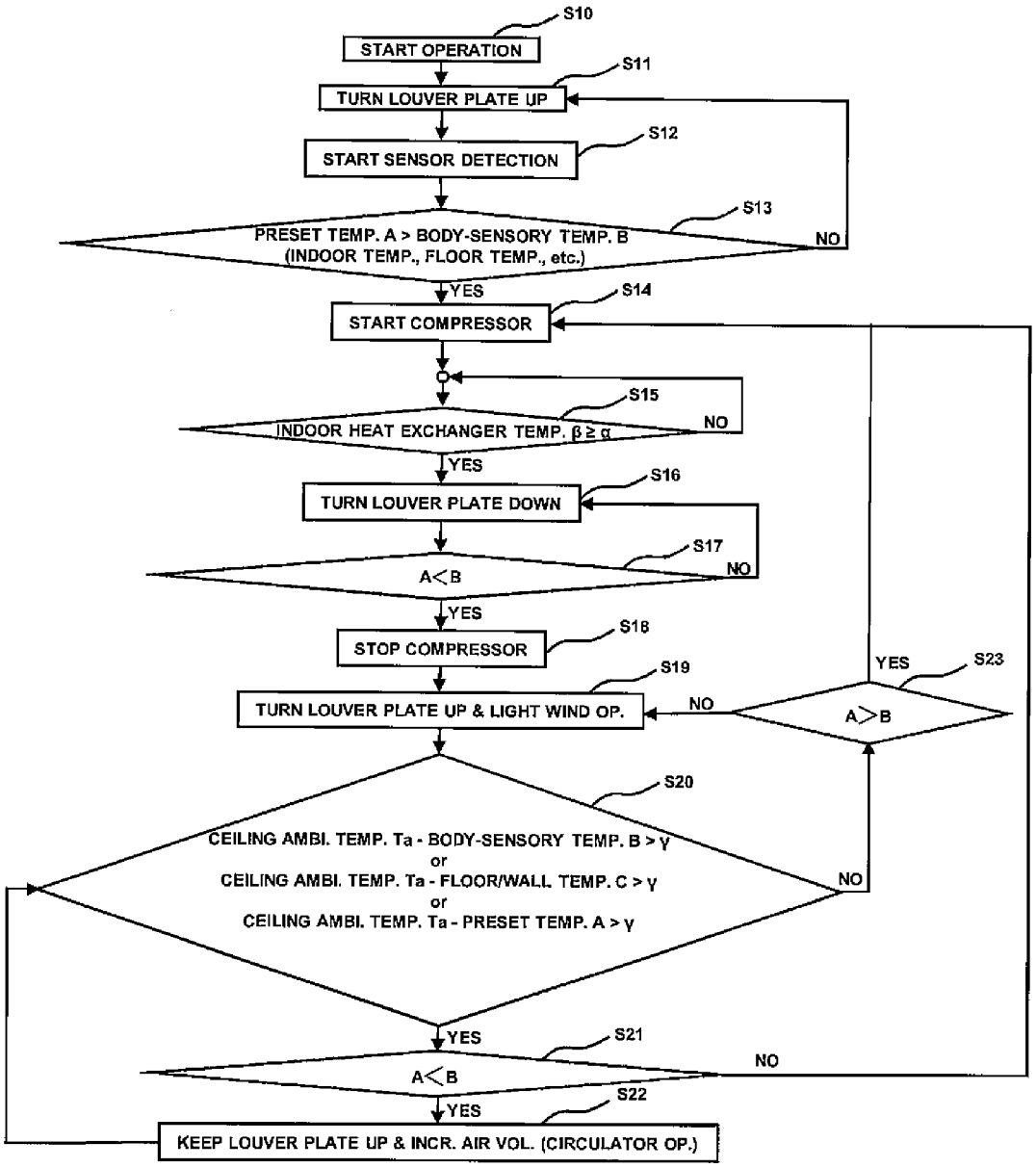
FIG. 5 shows a flowchart of an operation according to Embodiment 1.

Operations will now be described. FIG. 5 shows a flowchart of a heating operation of the air conditioner according to Embodiment 1. A user determines a preset temperature A of the indoor space by using an operation content setting means, such as a remote control device (not shown), and transmits it to the indoor unit 10 in order to start the operation. (For example, the preset temperature A is 24° C.)

When the operation is started (at the step S10), the indoor unit 10 turns the louver plate 17 upward (at S11) so that the conditioned air blown from the air outlet 12 may be at the ceiling side and higher than the horizontal plane of the air outlet 12, and detects an indoor temperature of the indoor space 30 by the indoor temperature sensor 13, and a temperature of the floor and wall by the thermopile type infrared sensor 14 (at S12).

The indoor microcomputer provided in the indoor control device calculates a body-sensory temperature B felt by the user, based on the indoor temperature, the floor temperature, and the wall temperature detected by the indoor temperature sensor 13 and the thermopile type infrared sensor 14. (For example, the calculated body-sensory temperature is 7° C.)

The indoor unit 10 transmits received information (heating mode data, and data on a difference between the body-sensory temperature B and the preset temperature A) to the outdoor control device 21 through the cable 40. Then, the compressor 22 performs operation at the optimum frequency, which quickly makes the indoor temperature approach the preset temperature A in the heating mode, based on the instruction of the outdoor microcomputer.

Here, if a difference between the preset temperature A and the body-sensory temperature B is: the preset temperature A>the body-sensory temperature B, such as the case of A=24° C. and B=7° C. herein shown, the operation of the compressor 22 is started (at S13 and S14). However, for example, in the case of A=24° C. and B=25° C., it returns to the step S11 from S13 without staring the operation of the compressor 22, and the blower device is stopped or performs light wind operation while keeping the louver plate 17 upward.

If the louver plate 17 is turned downward and the air volume of the blower device is increased immediately after starting the operation of the compressor 22, since the indoor heat exchanger has not been sufficiently warmed up, a cold conditioned air may make the user feel uncomfortable.

Therefore, until a pipe temperature thermistor (not shown), which measures a temperature β ° C. of the indoor heat exchanger, becomes a threshold value α ° C. of the pipe temperature, the operation of the blower device is kept stopped or light wind operation is kept performed (for example, the threshold value α of the pipe temperature is 40° C.). That is, in the case of β ° C.<α ° C. at the step S15, β being the temperature of the indoor heat exchanger and a being the threshold value of the pipe temperature, it returns to prior to the step S15, and the operation of the blower device is stopped or light wind operation is performed.

Figure 6:
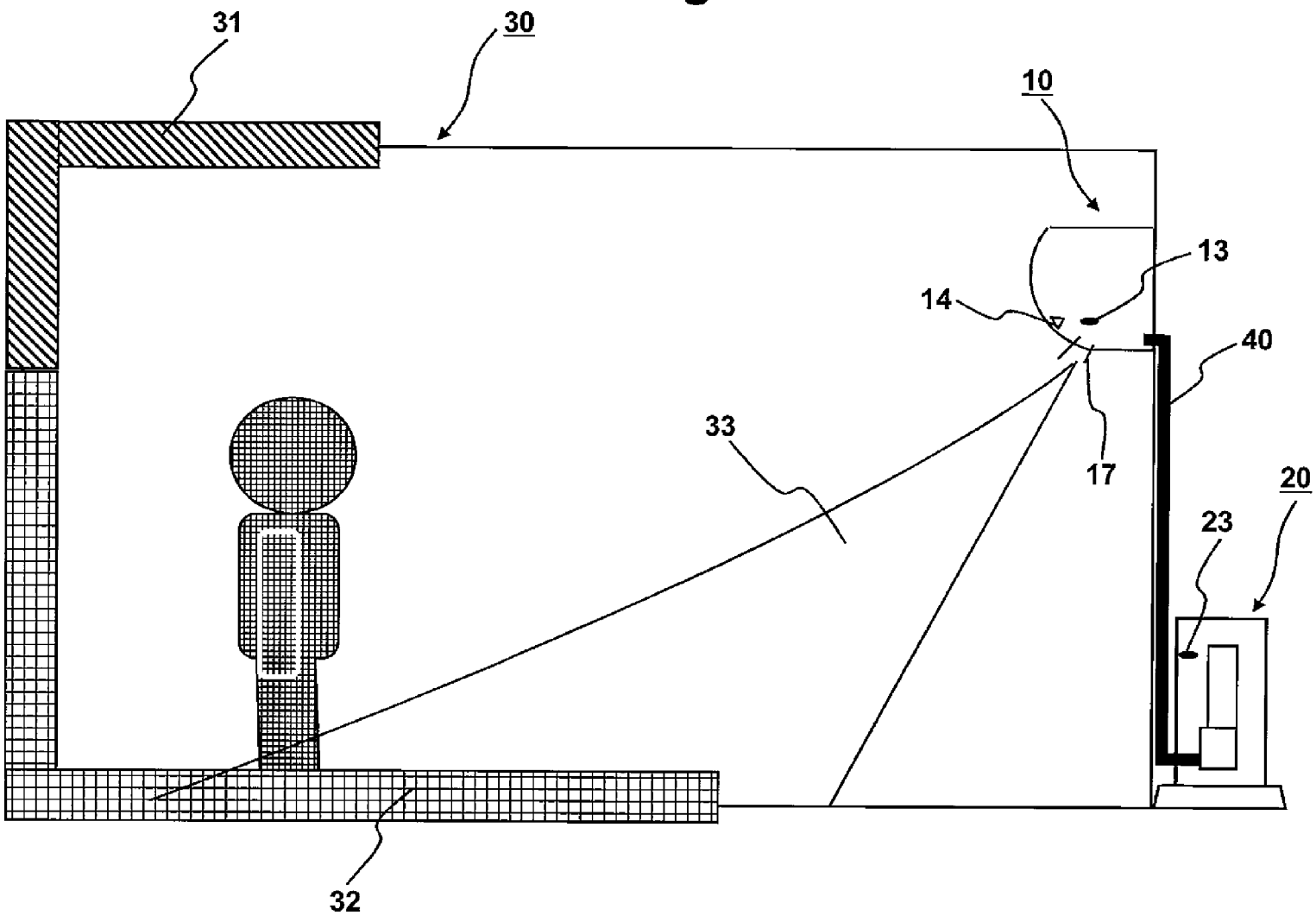
FIG. 6 shows a sectional view of the indoor space 30 to be air-conditioned by the air conditioner and a wind direction in heating operation according to Embodiment 1.

When the temperature β ° C. detected by the pipe temperature thermistor becomes the threshold value α ° C. (e.g., α=40), that is in the case of β ° C.≥α ° C. at the step S15, the heating operation of the indoor space 30 is performed such that the louver plate 17 is turned downward as shown in FIG. 6 and the air volume of the blower device is increased in order to let a blown-off air 33 reach the user's feet (at S16).

Then, the air conditioner performs the heating operation while varying the frequency of the compressor 22 so that the indoor temperature may be the preset temperature A ° C.

Conventionally, in the indoor unit of the air conditioner, controlling is performed only based on an indoor temperature sensor included in the indoor unit installed near the ceiling. Therefore, there has been a case where the indoor control device mistakes that it has reached a preset temperature A ° C. because of the warmth having a tendency to accumulate near the ceiling though the temperature of the place where the user is located is low, which easily occurs especially at the time of other heating apparatus being used in combination.

In the above case, the heating operation cannot make the user feel warm since the temperature of the place where the user is located is low. Then, the user may further raise the preset temperature to make air around the user warm, which leads the user to non energy saving.

FIG. 6 shows a sectional view of the indoor space 30 to be air-conditioned by the air conditioner and a wind direction in a heating operation according to Embodiment 1. Since the indoor unit 10 of the air conditioner provided with the thermopile type infrared sensor 14 can detect a floor and wall temperature C 32, the place where the user is located can be sufficiently warmed as shown in FIG. 6.

During the heating operation, the indoor temperature sensor 13 detects an indoor temperature, and the thermopile type infrared sensor 14 detects a floor and wall temperature and a ceiling ambient temperature in the indoor space 30 (the floor and wall temperature C 32 and the ceiling ambient temperature Ta 31). Based on these detected results, a body-sensory temperature B ° C. is calculated, and then, a difference between the body-sensory temperature B ° C. and the preset temperature A ° C. is calculated in order to control the air conditioner.

At the step S17, in the case of the body-sensory temperature B ° C. being higher than the preset temperature A ° C., the indoor control device transmits that the indoor space has reached the preset-temperature A ° C. to the outdoor control device 21 of the outdoor unit.

Receiving the instruction from the indoor control device, the outdoor control device 21 judges that the indoor space 30 has reached the preset temperature A ° C. set by the user and has become a stable temperature, and then stops the operation of the compressor 22 (at S18).

Figure 7:
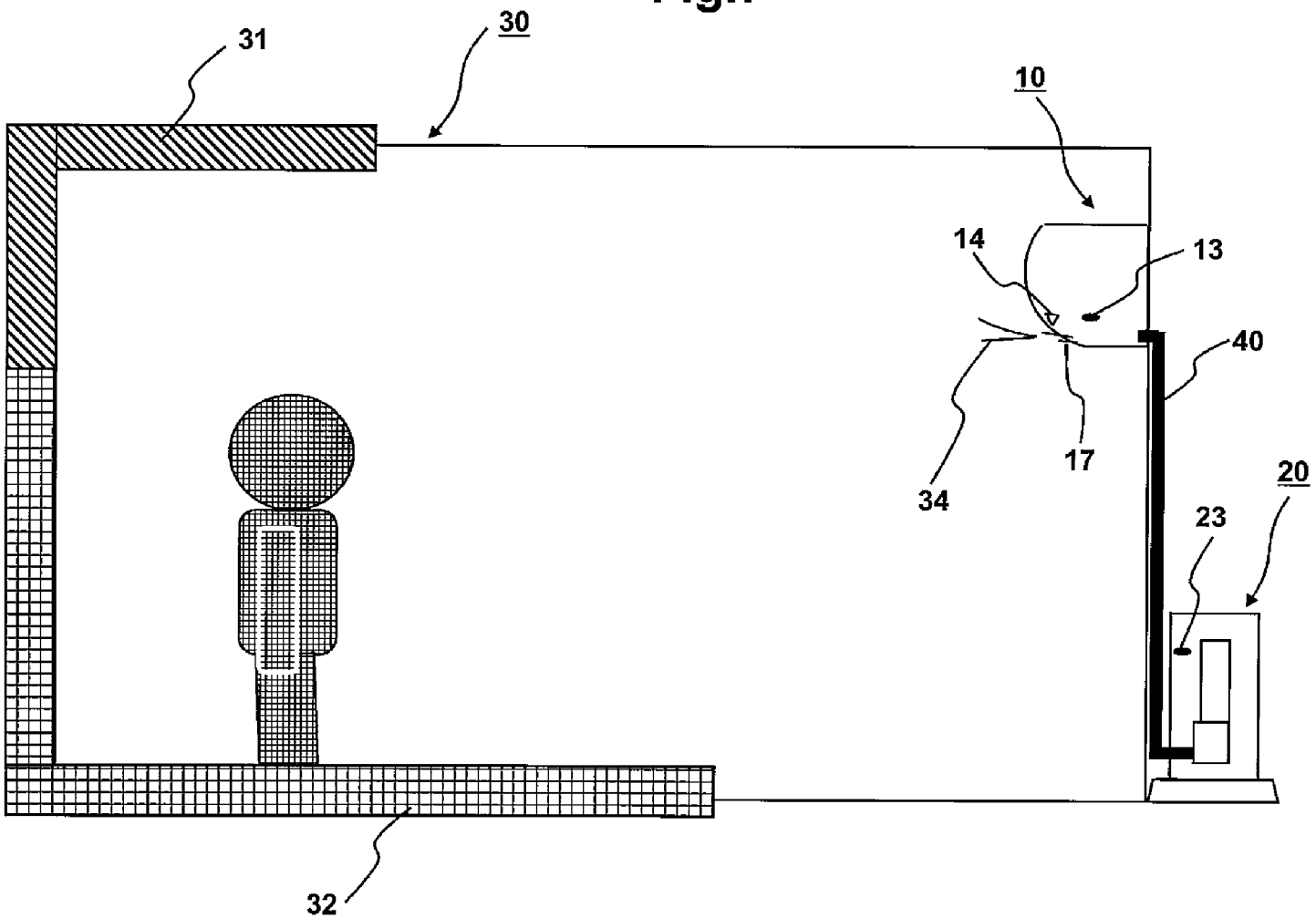
FIG. 7 shows a sectional view of the indoor space 30 to be air-conditioned by the air conditioner and a wind direction at the time of reaching a preset temperature in heating operation according to Embodiment 1.

FIG. 7 shows a sectional view of the indoor space 30 to be air-conditioned by the air conditioner and a wind direction at the time of reaching the preset temperature in a heating operation according to Embodiment 1. At this time, as shown in FIG. 7, the louver plate 17 of the indoor unit 10 is turned upward to be the ceiling side and higher than the horizontal plane of the air outlet 12, and the blower device provided in the indoor unit 10 performs light wind operation or stops performing the operation in order not to make the user feel a chilly wind caused by a blown-off air 34 (at S19).

Even when the indoor space has reached the preset temperature A ° C. and the blower device performs light wind operation or stops performing the operation, an indoor temperature is detected by the indoor temperature sensor 13, temperatures in the detection range X are perpendicularly detected by the thermopile type infrared sensor 14, and temperatures in the right to left direction are detected by rotating the thermopile type infrared sensor 14 about the axis in the vertical direction of the indoor unit 10. Thus, the floor and wall temperature C 32 and the ceiling ambient temperature Ta 31 are detected.

Figure 8:
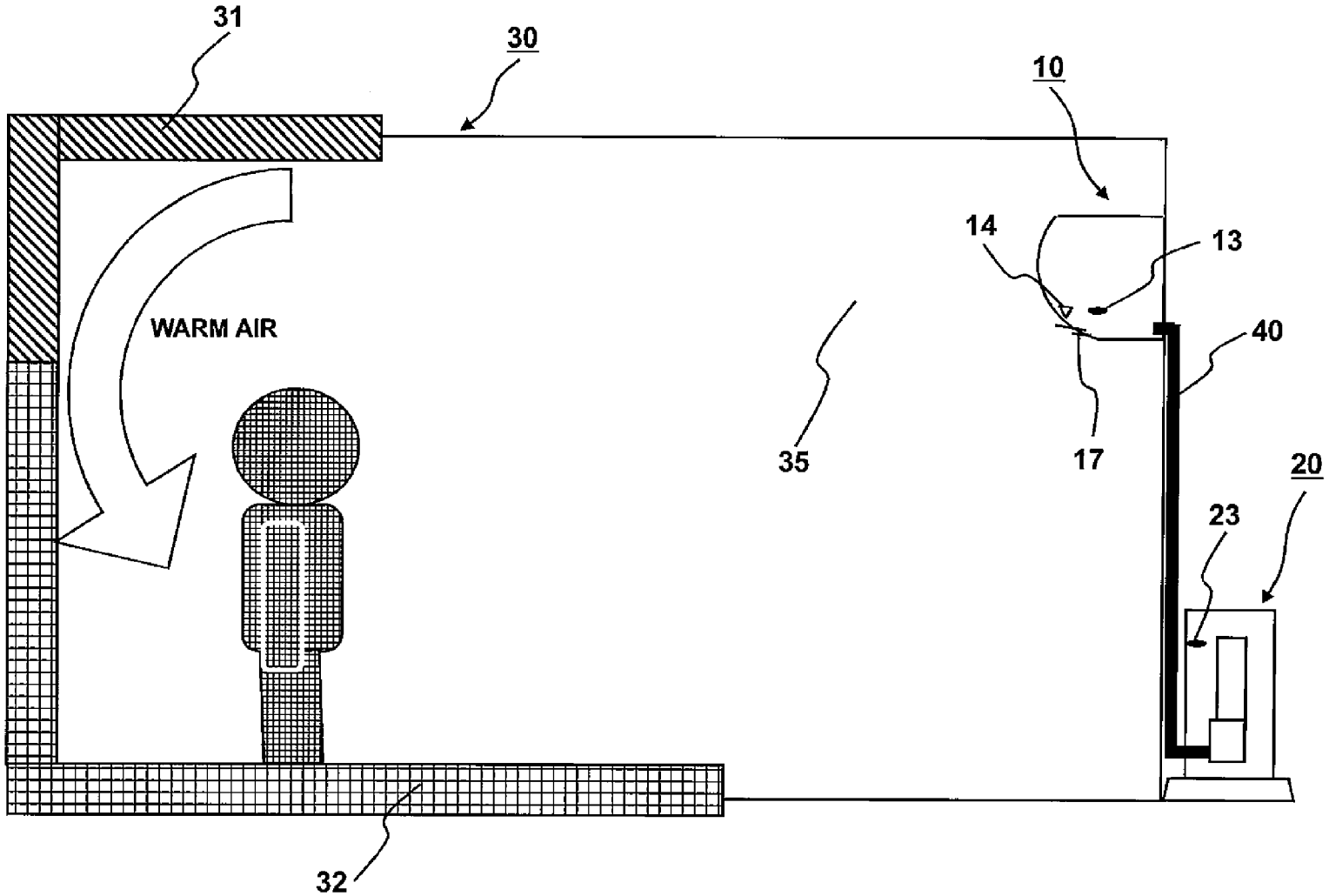
FIG. 8 shows a sectional view of the indoor space 30 to be air-conditioned by the air conditioner and a wind direction in circulator operation according to Embodiment 1.

FIG. 8 shows a sectional view of the indoor space 30 to be air-conditioned by the air conditioner and a wind direction in circulator operation according to Embodiment 1. Based on the detected results, a body-sensory temperature B ° C. is calculated similarly to the operation time. Then, in the case of comparing the ceiling ambient temperature Ta 31 with the calculated body-sensory temperature B ° C. and the comparison result is Ta−B>γ (e.g., γ=2 (degrees)), in the case of comparing the ceiling ambient temperature Ta 31 with the floor and wall temperature C 32 of the place corresponding to the user's feet and height and the comparison result is Ta−C>γ (e.g., γ=2 (degrees)), or in the case of comparing the ceiling ambient temperature Ta 31 with the preset temperature A set by the user and the comparison result is Ta−A>γ (e.g., γ=2 (degrees)) (at S20), it is judged that the temperature of the air above the user is warmer than the temperature (body-sensory temperature B) felt by the user. Furthermore, the preset temperature A and the body-sensory temperature B are compared (at S21). If the comparison result is: the preset temperature A<the body-sensory temperature B, the indoor unit 10 starts circulator operation of increasing the air volume of a blown-off air 35 by the blower device provided in the indoor unit 10 and moving the warm air accumulating overhead (near the ceiling) to the floor while keeping the louver plate 17 upward as shown in FIG. 8 (at S22).

In the case of none of Ta−B>γ, Ta−C>γ, and Ta−A>γ being satisfied at the step S20, a difference between the preset temperature A ° C. set by the user and the body-sensory temperature B ° C. is calculated (at S23). Then, if A>B, it returns to the step S14.

If A<B (degrees) at the step S23, it returns to S19.

Furthermore, if A>B at the step S21, it returns to S14.

Here, if maximizing the amount of air volume increase of the blower device in order to quickly move the warm air overhead to the floor, contrary to its intent, a problem occurs where such an air volume increase may give the user a feeling of air flow and make him feel chilly and uncomfortable.

With reference to the operation before starting circulator operation, since the indoor space 30 has reached the preset temperature A, the indoor unit 10 is performing quiet operation, namely light wind operation is being performed or operation is stopped (at S19). Therefore, when performing circulator operation, it is aimed to suppress a rapid noise increase by keeping the air volume to have a noise level of 40 dBA or less which is generally regarded as a level of a library or a quiet residential section in the daytime. This noise level indicates a noise at a point located 0.8 m perpendicularly downward from the center of the indoor unit 10 and 1 m horizontally from it.

With reference to the circulator operation, if performing ventilation to the ceiling at a maximum air volume based on judgment on only an operation time period and temperatures near the floor and near the ceiling, there may be not only a case of a noise caused by the ventilation sound and an air flow felt by the user, but also a case of stalling circulator operation when it has not reached the preset temperature. Thereby, the temperature around the user may be lowered and the user may feel uncomfortable.

Thus, in the case of performing circulator operation in the heating operation when a temperature of the indoor space 30 has reached a temperature set by the user, the direction of the louver plate 17 of the indoor unit 10 is upward more than the horizontal plane, and a ceiling ambient temperature Ta 31 is higher, by a certain threshold value γ or more (e.g., γ=2 (degrees)), than a preset temperature A, a body-sensory temperature B, or a floor and wall temperature C 32 of the place corresponding to the user's feet and height, effects can be obtained that user's discomfort caused by air flow feeling and noise level increase is removed and warm air overhead is moved to the floor by increasing the air volume up to the noise level of a blown-off air volume to be 40 dBA or less.

Embodiment 2

Figure 9:
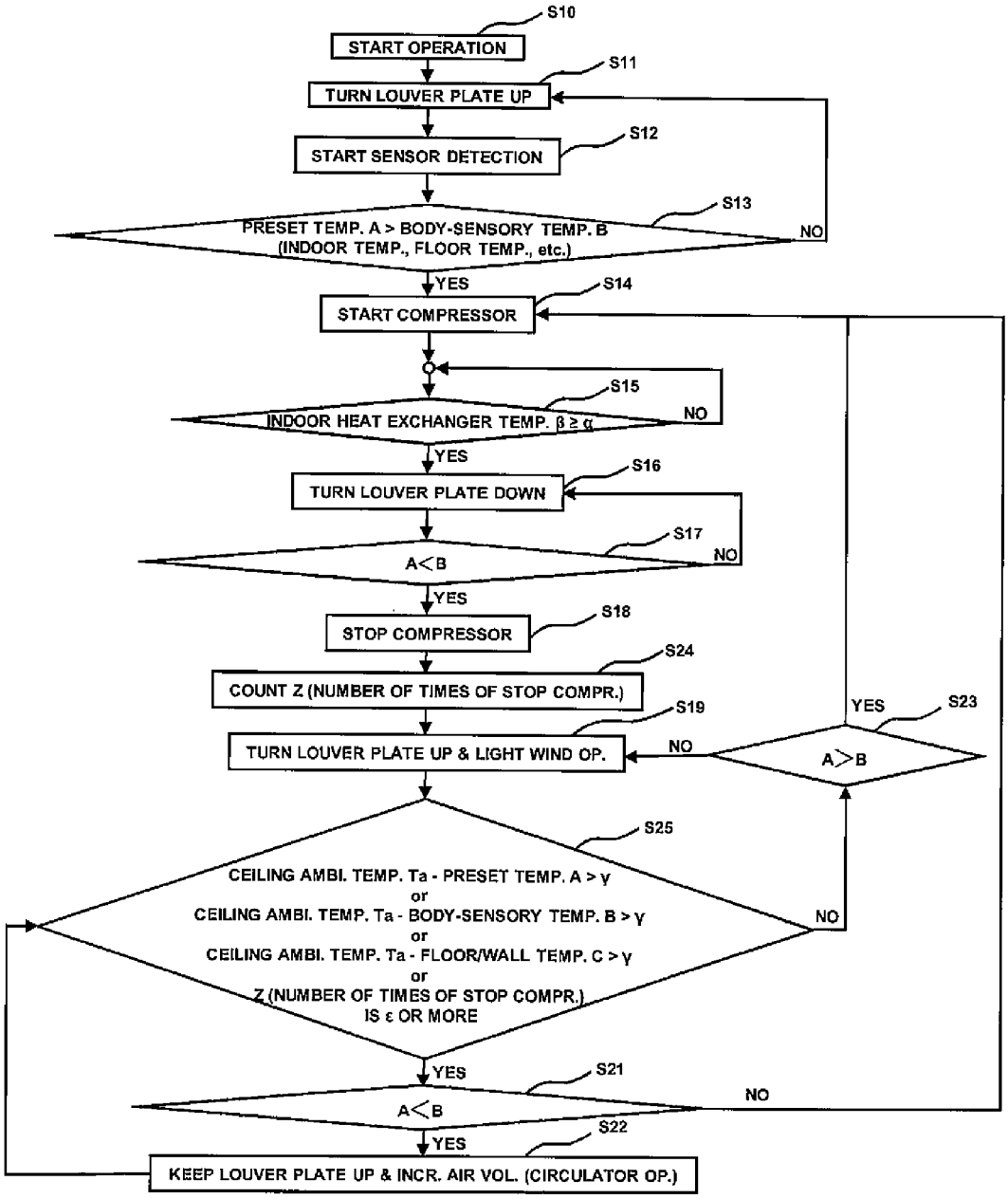
FIG. 9 shows a flowchart of an operation according to Embodiment 2.

FIG. 9 shows a flowchart of operations according to Embodiment 2. The point different from Embodiment 1 is that one condition for performing circulator operation is added as OR condition. This added condition is that circulator operation is to be started when the number of times Z becomes greater than or equal to a threshold value a, wherein Z indicates the number of times per hour of stopping the compressor 22 because a body-sensory temperature B has reached a preset temperature A.

The steps up to the step S18 in FIG. 9 are the same operations as those in FIG. 5 of Embodiment 1.

At the step S18, the outdoor control device 21 receives the instruction from the indoor control device, judges that the air temperature of the indoor space 30 has reached the preset temperature A ° C. set by the user and has become a stable temperature, and stops the operation of the compressor 22. Then, at S24, Z being the number of times of stopping the compressor 22 is counted and stored in the indoor control device or the outdoor control device 21. This step of counting and storing Z being the number of times of stopping the compressor 22 is defined to be a compressor-stopping-times counting unit.

Furthermore, at S19, the louver plate 17 of the indoor unit 10 is turned upward to be the ceiling side and higher than the horizontal plane of the air outlet 12 as shown in FIG. 7, and the blower device provided in the indoor unit 10 performs light wind operation or stops performing the operation in order not to make the user feel a chilly wind caused by the blown-off air 34.

Similarly to Embodiment 1, even when the indoor space has reached the preset temperature A ° C. and the blower device performs light wind operation or stops performing the operation, an indoor temperature is detected by the indoor temperature sensor 13, temperatures in the detection range X are perpendicularly detected by the thermopile type infrared sensor 14, and temperatures in the right to left direction are detected by rotating the thermopile type infrared sensor 14 about the axis in the vertical direction of the indoor unit 10. Thus, the floor and wall temperature C 32 and the ceiling ambient temperature Ta 31 are detected.

Based on the detected results, a body-sensory temperature B ° C. is calculated similarly to the operation time. Then, in the case of comparing the ceiling ambient temperature Ta 31 with the calculated body-sensory temperature B ° C. and the comparison result is Ta−B>γ (e.g., γ=2 (degrees)), in the case of comparing the ceiling ambient temperature Ta 31 with the floor and wall temperature C 32 of the place corresponding to the user's feet and height and the comparison result is Ta−C>γ (e.g., γ=2 (degrees)), in the case of comparing the ceiling ambient temperature Ta 31 with the preset temperature A set by the user and the comparison result is Ta−A>γ (e.g., γ=2 (degrees)), or in the case of the compressor stopping times Z>ϵ (e.g., ϵ=6 (number of timeshime interval)) (at S25), it is judged that the temperature of the air above the user is warmer than the temperature felt by the user. The indoor unit 10 starts circulator operation of increasing the air volume by the blower device provided in the indoor unit 10 and moving the warm air accumulating overhead to the floor while keeping the louver plate 17 upward as shown in FIG. 8.

As described above, one condition for performing circulator operation is added as OR condition. This added condition is that circulator operation is to be started when the number of times Z becomes greater than or equal to a threshold value a, wherein Z indicates the number of times per hour of stopping the compressor 22 because a body-sensory temperature B has reached a preset temperature A. In the following, there will be described a reason for adding this condition for starting circulator operation.

When performing heating using other heating apparatus, such as an electric heater, in combination with the heating operation by the air conditioner, since such other heating apparatus is not mechanically forced to send warm air to the floor, warm air accumulates near the ceiling.

Thus, in the combination operation, since the body-sensory temperature B becomes higher than the preset temperature A of the air conditioner, the mode of stopping the compressor 22 is frequently turned on, and warm air tends to easily accumulate near the ceiling when compared with the single operation by the air conditioner.

Therefore, as described above, one condition for starting circulator operation is added as OR condition, wherein the condition is that circulator operation is to be started when the number of times Z becomes greater than or equal to a threshold value ϵ (e.g., ϵ=6 (number of times/time interval)), wherein Z indicates the number of times per hour of stopping the compressor 22 because of having reached the preset temperature A.

Here, if maximizing the amount of air volume increase of the blower device in order to quickly move the warm air overhead to the floor, contrary to its intent, a problem occurs where such an air volume increase may give the user a feeling of air flow and make him feel chilly and uncomfortable.

Further, with reference to the operation before starting circulator operation, since the indoor space 30 has reached the preset temperature A, the indoor unit 10 is performing quiet operation, namely light wind operation is being performed or operation is stopped. Therefore, when performing circulator operation, it is aimed to suppress a rapid noise increase by keeping the air volume to have a noise level of 40 dBA or less which is generally regarded as a level of a library or a quiet residential section in the daytime.

With reference to the circulator operation, if performing ventilation to the ceiling at a maximum air volume based on judgment on only an operation time period and temperatures near the floor and near the ceiling, there may be not only a case of a noise caused by the ventilation sound and an air flow felt by the user, but also a case of starting circulator operation when it has not reached the preset temperature. Thereby, the temperature around the user may be lowered and the user may feel uncomfortable.

In the case of performing circulator operation in the heating operation when a temperature of the indoor space 30 has reached a temperature set by the user, the direction of the louver plate 17 of the indoor unit 10 is upward more than the horizontal plane, and a ceiling ambient temperature Ta 31 is higher, by a certain threshold value γ or more (e.g., γ=2 (degrees)), than a preset temperature A, a body-sensory temperature B, or a floor and wall temperature C 32 of the place corresponding to the user's feet and height, effects can be obtained that user's discomfort caused by air flow feeling and noise level increase is removed and warm air overhead is moved to the floor by increasing the air volume up to the noise level of a blown-off air volume to be 40 dBA or less.

By adding the condition that circulator operation is to be started when the number of times Z indicating the number of times of stopping the compressor 22 becomes greater than or equal to the threshold value E, it becomes possible to obtain a certain level effect, even in the case of failure of the thermopile type infrared sensor 14 or in the case of incapable of measuring a ceiling ambient temperature Ta 31 because of some obstruction in the detection range, or alternatively, even in the case of a model with no thermopile type infrared sensor 14.

Further, although the operation has been described with respect to heating operation, in other cases, such as using other heating apparatus in ventilation operation, the same effect can also be obtained by performing circulator operation when the thermopile type infrared sensor 14 performs sensing of the entire indoor space 30 and a comparison result between a ceiling ambient temperature Ta 31 and a body-sensory temperature B or a floor and wall temperature C 32 of the place where the user is located becomes greater than or equal to a threshold value γ.

Moreover, in the case of performing circulator operation when the outdoor temperature sensor 23 provided in the outdoor unit 20 judges that an outdoor temperature is low (e.g., 2° C. or less), the outdoor cold may come into the room floor and the user may feel uncomfortable. Therefore, by adding a condition for not starting circulator operation when the outdoor temperature sensor 23 judges that the outdoor temperature is low even if the above-described conditions for starting circulator operation are all satisfied, the possibility that the user may feel uncomfortable can be reduced.

REFERENCE SIGNS LIST

10: indoor unit, 11: air inlet, 12: air outlet, 13: indoor temperature sensor, 14: thermopile type infrared sensor, 15: receiving unit, 16: transmitting unit, 17: louver plate, 18: plug, 20: outdoor unit, 21: outdoor control device, 22: compressor, 23: outdoor temperature sensor, 24: heat exchanger, 25: blower, 30: indoor space, 31: ceiling ambient temperature Ta, 32: floor and wall temperature C, 33: blown-off air, 34: blown-off air, 35: blown-off air, 40: cable

What is claimed is:

1. An air conditioner which includes an indoor unit and an outdoor unit comprising: in the indoor unit, an indoor air temperature detection unit, provided at a predetermined position of the indoor unit, to detect an indoor air temperature;

a floor, wall, and ceiling temperature detection unit, provided at a front of the indoor unit, to detect a floor and wall temperature and a ceiling ambient temperature; and a control device including a microcomputer in which a program relating to control of the air conditioner is embedded, the microcomputer being configured to calculate a body-sensory temperature of a user based on the indoor air temperature detected by the indoor air temperature detection unit and the floor and wall temperature detected by the floor, wall, and ceiling temperature detection unit, wherein, in heating operation or ventilation operation, the control device is configured to compare an indoor air preset temperature set by a user and the body-sensory temperature when the ceiling ambient temperature detected by the floor, wall, and ceiling temperature detection unit becomes higher, by a predetermined threshold value or more, than the indoor air preset temperature, and to perform a circulator operation of moving air accumulating near a ceiling to a floor when the body-sensory temperature is higher than the indoor air preset temperature.

2. The air conditioner according to claim 1, wherein the floor, wall, and ceiling temperature detection unit uses a thermopile type infrared sensor which includes a plurality of elements.

3. The air conditioner according to claim 2, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

4. The air conditioner according to claim 1, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

5. An air conditioner which includes an indoor unit and an outdoor unit comprising: in the indoor unit, an indoor air temperature detection unit, provided at a predetermined position of the indoor unit, to detect an indoor air temperature;

a floor, wall, and ceiling temperature detection unit, provided at a front of the indoor unit, to detect a floor and wall temperature and a ceiling ambient temperature; and a control device including a microcomputer in which a program relating to control of the air conditioner is embedded, wherein, in heating operation or ventilation operation, the control device is configured to perform a circulator operation of moving air accumulating near a ceiling to a floor when the ceiling ambient temperature detected by the floor, wall, and ceiling temperature detection unit becomes higher, by a predetermined threshold value or more, than a body-sensory temperature felt by a user which is calculated based on the indoor air temperature detected by the indoor air temperature detection unit and the floor and wall temperature detected by the floor, wall, and ceiling temperature detection unit.

6. The air conditioner according to claim 5, wherein the floor, wall, and ceiling temperature detection unit uses a thermopile type infrared sensor which includes a plurality of elements.

7. The air conditioner according to claim 6, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

8. The air conditioner according to claim 5, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

9. The air conditioner according to claim 5, wherein, in heating operation or ventilation operation, the control device is configured to compare an indoor air preset temperature set by a user and the body-sensory temperature when the ceiling ambient temperature detected by the floor, wall, and ceiling temperature detection unit becomes higher, by a predetermined threshold value or more, than the body-sensory temperature, and to perform the circulator operation when the body-sensory temperature is higher than the indoor air preset temperature.

10. An air conditioner which includes an indoor unit and an outdoor unit comprising: in the indoor unit, an indoor air temperature detection unit, provided at a predetermined position of the indoor unit, to detect an indoor air temperature;

a floor, wall, and ceiling temperature detection unit, provided at a front of the indoor unit, to detect a floor and wall temperature and a ceiling ambient temperature; and a control device including a microcomputer in which a program relating to control of the air conditioner is embedded, wherein, in heating operation or ventilation operation, the control device is configured to perform a circulator operation of moving air accumulating near a ceiling to a floor when the ceiling ambient temperature detected by the floor, wall, and ceiling temperature detection unit becomes higher, by a predetermined threshold value or more, than the floor and wall temperature detected by the floor, wall, and ceiling temperature detection unit.

11. The air conditioner according to claim 10, wherein the floor, wall, and ceiling temperature detection unit uses a thermopile type infrared sensor which includes a plurality of elements.

12. The air conditioner according to claim 11, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

13. The air conditioner according to claim 10, wherein the outdoor unit includes a compressor, the control device includes a compressor-stopping-times counting unit to count and store a number of times per hour of stopping the compressor which is to be stopped when the indoor air temperature detected by the indoor air temperature detection unit has reached an indoor air preset temperature set by a user, and the circulator operation of moving the air accumulating near the ceiling to the floor is performed when the number of times of stopping the compressor becomes a predetermined threshold value or more.

14. The air conditioner according to claim 10, wherein the microcomputer is configured to calculate a body-sensory temperature of a user based on the indoor air temperature detected by the indoor air temperature detection unit and the floor and wall temperature detected by the floor, wall, and ceiling temperature detection unit, and wherein, in heating operation or ventilation operation, the control device is configured to compare an indoor air preset temperature set by a user and the body-sensory temperature when the ceiling ambient temperature detected by the floor, wall, and ceiling temperature detection unit becomes higher, by a predetermined threshold value or more, than the floor and wall temperature, and to perform the circulator operation when the body-sensory temperature is higher than the indoor air preset temperature.

15. An air conditioner which includes an indoor unit and an outdoor unit including a compressor comprising: in the indoor unit, an indoor air temperature detection unit, provided at a predetermined position of the indoor unit, to detect an indoor air temperature;

a control device including a microcomputer in which a program relating to control of the air conditioner is embedded; and a compressor-stopping-times counting unit, provided in the control device, to count and store a number of times per hour of stopping the compressor which is to be stopped when the indoor air temperature detected by the indoor air temperature detection unit has reached an indoor air preset temperature set by a user, wherein, in heating operation, the control device is configured to perform a circulator operation of moving air accumulating near a ceiling to a floor when the number of times of stopping the compressor counted by the compressor-stopping-times counting unit becomes a predetermined threshold value or more.

* * * * *